United States Patent [19]

Michel

[11] 4,308,038

[45] Dec. 29, 1981

[54] INERTIAL-ELECTROSTATIC WET PRECIPITATOR

[75] Inventor: Thomas J. Michel, Hialeah, Fla.

[73] Assignee: Santek, Inc., Hollywood, Fla.

[21] Appl. No.: 125,523

[22] Filed: Feb. 28, 1980

Related U.S. Application Data

[63] Continuation-in-part of Ser. No. 37,533, May 10, 1979, Pat. No. 4,230,466.

[51] Int. Cl.[3] ..... B03C 3/16; B03C 3/78

[52] U.S. Cl. ..... 55/118; 55/127; 55/228; 55/238; 55/459 C; 55/459 D; 55/DIG. 18; 261/79 A; 261/112

[58] Field of Search ..... 55/118–120, 55/127, 152, 228, 237, 238, 459 C, 459 D, DIG. 38, 235, 236, 385 A, DIG. 18; 261/79 A, 112

[56] References Cited

U.S. PATENT DOCUMENTS

| | | | |
|---|---|---|---|
| 2,351,864 | 6/1944 | Linderman, Jr. | 261/79 A |
| 2,668,599 | 2/1954 | Whittet | 55/119 |
| 2,684,232 | 7/1954 | Caldwell | 55/459 D |
| 2,757,581 | 8/1956 | Freeman et al. | 55/459 D |
| 2,937,709 | 5/1960 | deSeversky | 55/119 |
| 3,124,437 | 3/1964 | Lagarias | 55/13 |
| 3,485,011 | 12/1969 | Archer et al. | 55/152 |
| 3,509,911 | 5/1970 | Carsey | 55/DIG. 18 |
| 3,656,441 | 4/1972 | Grey et al. | 55/118 |
| 3,672,126 | 6/1972 | Goettle | 55/228 |
| 3,710,558 | 1/1973 | Feder | 55/338 |
| 3,744,217 | 7/1973 | Ebert | 55/118 |
| 3,750,373 | 8/1973 | Olson | 55/152 |
| 3,890,103 | 6/1975 | Konishi | 55/118 |

FOREIGN PATENT DOCUMENTS

| | | | |
|---|---|---|---|
| 22549 | 7/1936 | Australia | 55/459 D |
| 2052248 | 5/1972 | Fed. Rep. of Germany | 55/238 |
| 695039 | 8/1953 | United Kingdom | 55/235 |

*Primary Examiner*—David L. Lacey
*Attorney, Agent, or Firm*—Michael Ebert

[57] ABSTRACT

An inertial-electrostatic wet precipitator for removing particulate contaminants from a gaseous stream passing through a collector tube having a discharge electrode assembly coaxially disposed therein to establish an electrostatic field between the assembly and a liquid film on the inner surface of the tube which acts to ionize the particles in the gas. Liquid for flushing the particles is fed through a pipe spiralled about the precipitator tube, the pipe terminating in a nozzle ejecting the liquid tangentially into the inlet section of the tube to impart cyclonic motion thereto. As a result, liquid is caused to flow against the inner surface of the tube in a helical path to produce the liquid film which flows toward the outlet section of the tube and is discharged into a sump. The gaseous stream to be purified is also introduced tangentially in the same sense and direction into the inlet section of the tube to impart a cyclonic motion thereto causing the gas to flow in a helical path impinging on the liquid film and imposing a pneumatic pressure thereon serving to maintain the liquid film against the inner surface even when the tube is angled with respect to the vertical. Because of centrifugal forces produced by the cyclonic motion, the particles carried by gas passing through the tube are caused to migrate toward the liquid film, such migration being further promoted by electrostatic forces acting on the ionized particles whereby gas emerging from the outlet section is substantially free of contaminants.

7 Claims, 3 Drawing Figures

Figures 1, 2, 3:
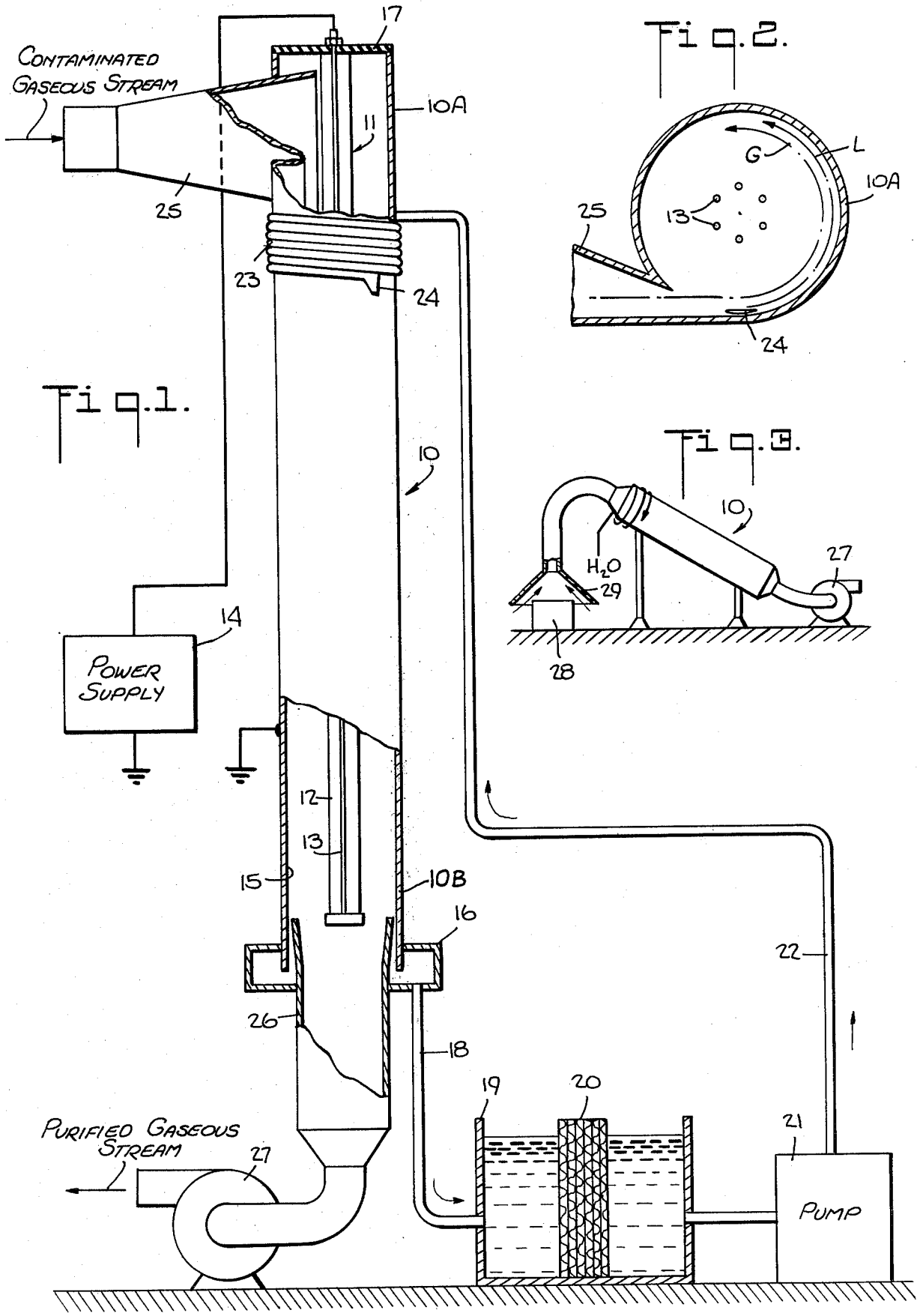

Contaminated Gaseous Stream
Power Supply
Purified Gaseous Stream
Pump $H_2O$
17
10A
11
25
23
24
10
14
12
13
15
10B
16
26
18
19
20
21
22
27
G
L
28
29

INERTIAL-ELECTROSTATIC WET PRECIPITATOR

RELATED APPLICATION

This application is a continuation-in-part of my copending application Ser. No. 037,533, filed May 10, 1979, now U.S. Pat. No. 4,230,466 titled "Discharge Electrode Structure for Electrostatic Precipitator," the entire disclosure of which is incorporated herein by reference.

BACKGROUND OF INVENTION

This invention relates generally to precipitators for removing particulate contaminants from a gaseous stream, and more particularly to an inertial-electrostatic precipitator in which ionized particles are caused to migrate toward a downwardly-flowing liquid film formed on the inner surface of a collector tube, the migration resulting from the combined action of electrostatic and centrifugal force whereby the stream may be purified in the course of its passage through a relatively short tube.

Electrostatic precipitators function to separate contaminating particles or droplets of a semi-solid or solid nature from a gaseous stream. Such precipitators are especially helpful in removing finer particles (less than 40$\mu$). In one known form of electrostatic precipitator of the dry type, the gases to be purified are conveyed through a collector tube where they are subjected to an electrostatic field which ionizes the particles and causes migration toward the inner surface of the collector tube, thereby separating the particles from the gas flowing through the tube. With continued operation of a dry precipitator, the particles accumulate on the wall of the collector tube and it becomes necessary, therefore, at fairly frequent intervals, to shut down the precipitator in order to permit removal of the agglomerated particles.

With a wet wall precipitator of the type disclosed, for example, in the deSeversky U.S. Pat. No. 3,716,966, a uniform film of downwardly flowing water is formed on the inner wall of the collector tube, the film serving to continuously flush away the contaminants, thereby obviating the need to interrupt the precipitator operation.

While large particles suspended in an air stream are also ionized in an electrostatic field, their migration velocity is usually so low that they tend to be swept out by the gas stream before reaching the electrostatic collecting surfaces. Hence conventional electrostatic precipitators are less effective with respect to coarse particles carried by the contaminated gas.

The use of centrifugal separators or cyclonic collectors for separating dust particles and other particulate contaminants of 25$\mu$ or larger from a gaseous stream is well known. In order, therefore, to effectively remove both large and small particles from a gaseous stream, one may feed the gaseous stream first through a cyclonic collector or inertial dust separator stage to extract the large particles from the stream and then through an electrostatic precipitator stage to extract the small particles therefrom. Thus U.S. Pat. No. 3,315,445 to deSeversky discloses a pollution control system in which gas scrubber and wet electrostatic precipitator stages are intercoupled in cascade relation so as to remove the full spectrum of contaminants from the stream.

The drawback to a gas scrubber, a centrifugal collector or other form of coarse particle separator operating in series with an electrostatic precipitator is that this combination requires elaborate and costly duct work to convey the gaseous stream through the serially connected stages. Moreover, the gas emitted from the first stage may not have a velocity profile appropriate to the second stage. To overcome this drawback, in the deSeversky U.S. Pat. No. 3,315,445, the scrubber stage is designed to modify the gas flow pattern so that gas emerging from the gas scrubber has a laminar flow characteristic and a uniform velocity profile. Nevertheless, the resultant combined structure is relatively tall and massive, for the electrostatic precipitator stage is stacked directly above the scrubber stage.

While a tall, vertically-mounted precipitator arrangement represents no serious problem when this structure is installed outside a building whose contaminated exhaust must be purified before being discharged into the atmosphere, in some cases the need exists for interior precipitator installation, such as in cotton processing plants and in other dust-producing facilities as well as in so-called "clean rooms" for processing electronic components where it is necessary to recirculate the atmosphere through a filter or other dust in order to remove particulate contaminants therefrom. In such cases, the available headroom may be insufficient to accommodate a vertically-mounted precipitator installation.

SUMMARY OF INVENTION

In view of the foregoing, the main object of this invention is to provide a compact, inertial-electrostatic wet wall tubular precipitator in which both coarse and fine particles are extracted from a gaseous stream by the combined action of centrifugal and electrostatic forces.

A significant feature of the invention resides in the use of a relatively short precipitator tube through which the gaseous stream and the flushing liquid are caused to flow in helical paths, thereby effectively extending the operating length of the tube.

Also an advantage of the invention is that the precipitator tube is capable of functioning at an angle with respect to the vertical without causing the liquid film on the inner surface of the tube to shear off the wall and disrupt the operation of the precipitator. As a consequence, a precipitator laid on its side may be installed in the interior of industrial plants and other environments lacking adequate head room to permit a vertical mounting.

More particularly, an object of this invention is to provide an inertial-electrostatic precipitator in which the gaseous stream and the flushing liquid are introduced tangentially in the same sense to create a helical liquid path forming a liquid film on the inner surface of the collector tube and a helical gaseous path impinging on the film imposing a pneumatic pressure thereon to maintain the film against the tube surface.

Also an object of the invention is to provide an inertial-electrostatic precipitator which operates reliably and efficiently and which may be constructed at low cost.

Briefly stated, these objects are realized in an inertial-electrostatic wet-wall precipitator in accordance with the invention for removing particulate contaminants from a gaseous stream flowing through a collector tube having a discharge electrode assembly coaxially disposed therein to establish an electrostatic field between the assembly and a liquid film formed on the inner surface of the tube, the field acting to ionize the particles carried by the gas.

Liquid for flushing the contaminants is conducted at high velocity through a pipe spiralled about the tube and terminating in a nozzle ejecting the liquid tangentially into the inlet section of the tube, thereby imparting a cyclonic motion to the liquid causing it to flow against the inner surface of the tube in a helical path to create a liquid film thereon which is discharged at the outlet section into a sump.

The gaseous stream to be purified is introduced at high velocity tangentially into the inner section of the tube in the same sense as the liquid, thereby imparting a cyclonic motion to the gas, thereby causing it to flow in a helical path impinging the liquid film and imposing a pneumatic pressure thereon serving to maintain the film against the inner tube surface even when the tube is angled with respect to the vertical.

Because of centrifugal forces produced by the cyclonic motion, the particles carried by the gas passing through the precipitator tube are caused to migrate toward the liquid film, such migration being further promoted by electrostatic forces acting on the ionized particles whereby the gas emerging from the outlet section is substantially free of contaminants.

OUTLINE OF DRAWINGS

For a better understanding of the invention as well as other objects and further features thereof, reference is made to the following detailed description to be read in conjunction with the accompanying drawings, wherein:

FIG. 1 is an elevational view of an inertial-electrostatic precipitator in accordance with the invention, the precipitator tube being partially cut away to expose the interior thereof;

FIG. 2 schematically illustrates the manner in which the gaseous stream and the liquid are tangentially introduced into the precipitator tube; and FIG. 3 schematically shows an alternative manner of mounting the precipitator.

DESCRIPTION OF INVENTION

Referring now to FIG. 1, there is shown an inertial-electrostatic precipitator in accordance with the invention which includes a vertically-mounted precipitator tube 10 whose inlet section 10A is covered by a disc 17 of insulation material and outlet section 10B is open. From disc 17 there is suspended a discharge electrode assembly 11, preferably of the type disclosed in my above-identified copending application, the assembly being coaxially disposed within the collector tube.

The assembly includes a column 12 of dielectric material whose central axis is coincident with the axis of collector tube 10. Column 12 has a cross-sectional geometry that defines a circular series of longitudinally-extending niches. Supported between the ends of the column is a circular array of fine gauge wires 13, only one of which is visible in FIG. 1, each wire being disposed within a respective niche. Because the discharge wires are supported from the ends of the column which also acts as a structural member, there is no need to support the assembly at the lower end thereof.

A high voltage produced by a power supply 14 is impressed between the wires 13 in the array and grounded collector tube 10 which is of conductive material, thereby creating an electrostatic field in the annular gas flow region between the discharge electrode assembly and a film of liquid 15 on the inner surface of the tube. This field acts to ionize particulate contaminants carried by the gaseous stream passing through the tube. In practice, the gaseous stream before being admitted into the tube may be pre-ionized.

The downwardly-flowing liquid film which flushes away the contaminants is discharged into an annular sump 16 which surrounds the outlet section of the tube. The flushing liquid can be any non-reactive liquid compatible with the gas to be treated. In practice this liquid is usually water. Should use be made of a collector tube of electrically insulating material such as a ceramic cylinder, use is then made of a liquid rendered electrically conductive by a suitable salt dissolved therein, the liquid in this case being grounded.

Sump 16 is emptied by a pipe 18 into an open reservoir 19 which is provided with a removable filter 20 to extract contaminants flushed from the precipitator from the liquid flowing through the reservoir. The reservoir is coupled to a pump 21 whose output is fed by a line 22 to a spiralled pipe 23. This pipe is coiled about inlet section 10A of the precipitator tube and terminates in a nozzle 24. In practice, in lieu of a single nozzle, a series thereof may be employed.

The arrangement is such that the pumped liquid is ejected at high velocity tangentially into the inlet section of the precipitator tube. Because of the rotational momentum created by the flow of liquid through the spiralled pipe 23 followed by tangential ejection of the liquid into the inlet section of the precipitator tube, the liquid is caused to undergo cyclonic movement thereon. And because the force of gravity seeks to draw the liquid down the tube, the liquid is caused to spiral downwardly against the inner surface of the tube in a helical path, thereby producing the desired liquid film on this surface. The centrifugal forces created by cyclonic motion tend to hold the liquid film against this surface. It is important that the film not be peeled from the collector tube, for liquid in the flow passage may result in sparking and breakdown of the electrostatic system.

A continuous supply of liquid is not necessary, for the liquid is recycled. The contaminated liquid from the outlet section is discharged into the reservoir where it is filtered before being pumped back into the inlet section of the precipitator tube. Make-up liquid may be supplied to the reservoir to take care of evaporation and other losses. When filter 20 is loaded with contaminants, it may be removed for cleaning without, however, interrupting the operation of the liquid system.

The gaseous stream to be processed is introduced into inlet section 10A through a spinner duct 25 constituted by a horn-shaped transition section having a flattened mouth which feeds the gaseous stream tangentially into the inlet section at high velocity to cause cyclonic movement of the gas.

Received within outlet section 10B of the precipitator tube is a flue 26 whose flared inner end is spaced from the inner surface of the tube to avoid disrupting the downward flow of liquid into sump 16. Flue 26 is coupled to a blower fan 27 whose purified output is discharged into the atmosphere.

Thus the contaminated gaseous stream is fed tangentially into the inlet section and is caused to spin cyclonically therein, fan 27 producing a suction force in the tube causing the gas to spiral downwardly therein in a helical path which has the same sense as the liquid helix to define a double helix within the tube. The gas helix impinges on the liquid film and imposes a pneumatic pressure thereon to hold the liquid film against the collector tube. The parameters of the system are such that this pneumatic pressure is sufficiently high to prevent the film from shearing off the collector surface even if the tube is mounted at an inclined position on its side rather than vertically.

The gaseous stream which carries particulate contaminants is drawn at high velocity into the inlet section of precipitator tube 10 and emerges from the outlet section thereof with virtually all contaminants removed. The manner in which the particles are removed will be explained in greater detail in connection with FIG. 2, where it will be seen that curved arrow L represents liquid ejected tangentially from nozzle 24 to create a downwardly flowing film on the inner surface of the precipitator tube. Concurrently the contaminated gaseous stream to be processed is also introduced tangentially, as represented by arrow G, which gas moves in the same direction as liquid L.

Because of the centrifugal forces created by the cyclonic motion of the gas within the precipitator tube, the momentum imparted to the particles in the gas stream causes the particles to migrate laterally toward the liquid film and to be flushed away thereby. As pointed out previously, such inertial separation is more effective with relatively coarse particles than with fines.

However, the electrostatic field created by discharge electrode wires 13, which field extends between these wires and the water film and is intercepted by the flowing gas, ionizes the particles carried by the gas and causes them, by reason of electrostatic forces, to migrate toward the water film, this force being more effective with respect to fine particles. Hence the combined action of inertial and electrostatic forces acting on the particles causes the full spectrum of particle sizes to be extracted from the gaseous stream.

As shown in FIG. 3, precipitator 10, instead of being vertically mounted, may be mounted at an angle to reduce the head room requirements therefor. The inlet section must, of course, be somewhat higher than the outlet section to cause downward flow of the liquid film. Thus in an industrial plant having a dust-producing working station of some sort represented by block 28, to remove this dust, a hood 29 is placed above the station to pick up the dust-laden air and to feed this air stream into the inlet section of the precipitator in the manner previously described, the precipitator discharging clean air.

The inertial-electrostatic precipitator in accordance with the invention, since it is capable of removing the full spectrum of particle sizes, may be installed in clean rooms where even the slightest degree of dust contamination cannot be tolerated. And because the air need not be forced through micronic mechanical filters as in conventional clean room purification systems, the energy requirements of the precipitator are relatively low.

While there has been shown and described a preferred embodiment of an inertial-electrostatic wet precipitator in accordance with the invention, it will be appreciated that many changes and modifications may be made therein without, however, departing from the essential spirit thereof.

I claim:

1. An inertial-electrostatic precipitator for extracting both coarse and fine particular contaminants from a gaseous stream to produce a decontaminated stream, said precipitator comprising:

A a cylindrical collector tube mountable along an axis that may be tilted with respect to the vertical and provided with an upper inlet section and a lower outlet section;

B a discharge electrode assembly coaxially disposed within said tube to establish an electrostatic field therein;

C means to feed liquid into said collector tube including a liquid pump supplying liquid to a pipe having a plurality of convolutions coiled about said inlet section of the tube to impart rotational momentum to the pressurized liquid flowing therethrough, the pipe terminating in a nozzle positioned and arranged to eject the liquid tangentially into the inlet section at high velocity to impart cyclonic motion thereto causing the liquid to flow downwardly toward the outlet section against the inner surface of the tube in a helical path to form a liquid film thereon, the cyclonic motion creating centrifugal forces tending to hold said film against the inner surface even when the tube is tilted;

D gas inlet means for delivering a gaseous stream into said collector tube including a horn-shaped diverging duct with a flattened mouth positioned and arranged to introduce said gaseous stream tangentially into the inlet section at high velocity to impart cyclonic motion to cause the gas to impinge on the liquid film and to impose a penumatic pressure thereon serving to maintain the film against said inner surface even when the tube is tilted, the centrifugal forces created by the cyclonic motion of the gas causing particles therein to migrate toward said film, which migration is further promoted by electrostatic forces produced by said field and ionizing said particles, E A blower coupled to the outlet section of the tube to draw the decontaminated stream from the tube and to discharge it into the atmosphere; and F an annular sump means disposed below the outlet section to receive the liquid discharged therefrom.

2. A precipitator as set forth in claim 1, wherein said assembly comprises a column of dielectric material having a cross-sectional geometry that defines a circular series of longitudinally-extending niches and a circular array of fine gauge wires supported between the ends of the column, each wire being suspended within a respective niche.

3. A precipitator as set forth in claim 2, wherein said inlet section is covered by a disc from which said column is suspended.

4. A precipitator as set forth in claim 1, further including a reservoir of liquid disposed below said sump means and coupled by a gravity flow pipe thereto, said reservoir having an outlet coupled to said pump to recycle the liquid through the collector tube.

5. A precipitator as set forth in claim 4, wherein said reservoir is provided with a removable filter to extract the particles from the liquid passing therethrough.

6. In combination with a precipitator as set forth in claim 1, a work station generating said contaminants, further including a hood placed over said work station to pick up said contaminants, said hood being coupled to said duct.

7. The combination as set forth in claim 6, further including means to support said collector tube at a tilted position, whereby the effective height of the precipitator is reduced.

* * * * *